US011692707B2

(12) United States Patent
Pablo Curto et al.

(10) Patent No.: US 11,692,707 B2
(45) Date of Patent: Jul. 4, 2023

(54) COOKING APPLIANCE

(71) Applicant: ORKLI, S.COOP., Ordizia (ES)

(72) Inventors: Marcos Pablo Curto, Hernani (ES); Andoni Unanue Imaz, Idiazabal (ES)

(73) Assignee: ORKLI, S.COOP., Ordizia (ES)

( * ) Notice: Subject to any disclaimer, the term of this patent is extended or adjusted under 35 U.S.C. 154(b) by 358 days.

(21) Appl. No.: 17/198,935

(22) Filed: Mar. 11, 2021

(65) Prior Publication Data

US 2021/0199290 A1 Jul. 1, 2021

Related U.S. Application Data

(63) Continuation of application No. PCT/ES2019/070667, filed on Oct. 3, 2019.

(30) Foreign Application Priority Data

Oct. 16, 2018 (EP) ..... 18382739

(51) Int. Cl.
*F23N 5/10* (2006.01)
*F23N 5/24* (2006.01)
(Continued)

(52) U.S. Cl.
CPC ..... *F23N 5/102* (2013.01); *F23N 5/105* (2013.01); *F23N 5/242* (2013.01); *F23Q 3/008* (2013.01); *F24C 3/103* (2013.01); *F23D 2207/00* (2013.01)

(58) Field of Classification Search
CPC ..... F23N 5/102; F23N 5/105; F23N 5/242; F23Q 3/008
(Continued)

(56) References Cited

U.S. PATENT DOCUMENTS 4,626,196 A 12/1986 Stohrer
5,119,802 A * 6/1992 Cherry ..... F24C 15/2042 D7/346
(Continued)

FOREIGN PATENT DOCUMENTS

FR 2666401 A1 3/1992
GB 2276233 A 9/1994

OTHER PUBLICATIONS

International Search Report and Written Opinion received in PCT/ES2019/070667, dated Jan. 27, 2020 (13 pages).
(Continued)

*Primary Examiner* — Vivek K Shirsat
(74) *Attorney, Agent, or Firm* — Edell, Shapiro & Finnan, LLC

(57) ABSTRACT

Gas cooking appliance including at least one burner and an ignition device configured to ignite the burner. The ignition device includes a pulse generator configured to send at least one electric pulse for the purpose of generating a spark to ignite the burner. The cooking appliance also includes a flame detector configured to detect the presence/absence of a flame in the burner. The pulse generator is in electrical contact with a part of the burner and the flame detector is connected to ground. The cooking appliance further includes insulating means that insulates the burner with respect to ground, such that when the pulse generator sends at least one electric pulse, an electric spark capable of igniting the burner is generated between the burner and the flame detector.

19 Claims, 4 Drawing Sheets

(51) Int. Cl.
*F23Q 3/00* (2006.01)
*F24C 3/10* (2006.01)

(58) Field of Classification Search
USPC ..... 431/264; 126/39 E, 39 R
See application file for complete search history.

(56) References Cited

U.S. PATENT DOCUMENTS

| | | | | |
|---|---|---|---|---|
| 5,636,978 | A * | 6/1997 | Sasaki | F23N 5/203 431/73 |
| 9,746,182 | B2 | 8/2017 | Blalock | |
| 9,822,978 | B2 | 11/2017 | Strong | |
| 2014/0302445 | A1 | 10/2014 | Bianchi | |
| 2018/0073730 | A1 | 3/2018 | Acosta Herrero | |

OTHER PUBLICATIONS

Extended European Search Report received in EP18382739.3, dated Mar. 25, 2019 (5 pages).

* cited by examiner

COOKING APPLIANCE

CROSS-REFERENCE TO RELATED APPLICATIONS

This application relates to and claims the benefit and priority to International Application No. PCT/ES2019/070667, filed Oct. 3, 2019, which claims the benefit and priority to European Application No. EP18382739.3, filed Oct. 16, 2018.

FIELD

The present invention relates to a cooking appliance comprising gas-fed burners, ignition devices for igniting the burners, and flame detectors configured for detecting the presence/absence of flame in the burner.

BACKGROUND

Gas cooking appliances comprising a plurality of gas-fed burners, an ignition device which in turn comprises a spark-generating plug, and a thermocouple associated with each burner and connected with a safety valve, are known in the prior art. In this sense, U.S. Publication No. 2014/0302445A1, for example, discloses a cooking appliance, wherein the igniter device is controlled depending on the electrical signal generated by the thermocouple.

SUMMARY

According to one embodiment, a gas cooking appliance is provided that includes at least one burner connected to a gas supply, an ignition device configured for igniting the burner, the ignition device comprising a pulse generator configured for sending at least one electric pulse generating a spark which ignites the burner, and a flame detector configured for detecting the presence/absence of flame in the burner. The pulse generator is in electrical contact with the burner and the flame detector is connected to ground.

The gas cooking appliance further comprises insulating means insulating the burner with respect to ground, such that when the pulse generator of the ignition device sends at least one electric pulse, a spark capable of igniting the burner is generated between the burner and the flame detector.

A gas cooking appliance with a more efficient ignition system is thereby obtained. The inexistence of the spark plug for igniting the burner thereby prevents common ignition problems due to dirt or dampness in the spark plug which cause incorrect spark ignition. In this case, the spark is ignited from the burner above the flame detector.

Cleaning of the burner is also made easier since the spark plug no longer exists. Furthermore, symmetrical burners are obtained as a concealed gap for the spark plug is not required, improving burner performance.

These and other advantages and features will become evident in view of the drawings and detailed description.

DETAILED DESCRIPTION

Figure 1:
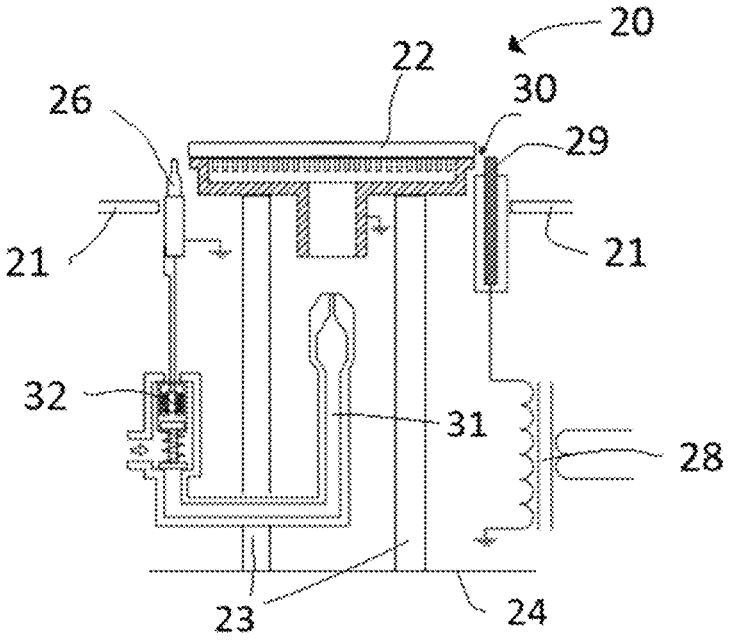
PRIOR ART FIG. 1
FIG. 1 shows a partial sectioned view of a gas cooking appliance of the prior art with a diagram of its electrical connections.

FIG. 1 shows a partial schematic view of a gas cooking appliance 20 known in the prior art. The gas cooking appliance 20 comprises burners 22 (only one burner 22 is shown in FIG. 1) connected to a respective gas supply conduit 31, a cooktop 21, the burners 22 and supports 23 partially projecting above it, wherein the burners 22 are attached to a (schematically depicted) chassis 24 of the cooking appliance 20 through the supports 23 that are configured for supporting the burners 22. The supports 23 are made of an electrically conductive material, preferably a metallic material.

The gas cooking appliance 20 comprises a thermocouple 26 associated with each burner 22 and configured for detecting the presence/absence of flame in the burner 22. The thermocouple 26 is connected to ground and to an electromagnetic safety valve 32 which opens or closes the gas passage through the gas supply conduit 31, such that once the gas passage to the burner 22 is open, in the event that the thermocouple 26 does not detect flame in the burner 22, it would stop feeding the corresponding electromagnetic valve 32, with the gas passage to the burner 22 closing. The operation of the thermocouple along with the electromagnetic valve is known in the prior art, so it is not considered necessary to describe it in further detail.

In the prior art, the gas cooking appliance 20 comprises a spark plug 29 connected to a spark generator 28. The burner 22 is connected to ground, such that when the spark generator 28 sends current pulses to the spark plug 29, a spark 30 capable of igniting the burner 22 is generated between the spark plug 29 and the burner 22.

FIGS. 2 to 6 show schematically embodiments of a gas cooking appliance 1; 1'; 1"; 1''' according to the invention. The gas cooking appliance 1; 1'; 1"; 1''' comprises burners 3 (only one burner 3 is shown in FIGS. 2, 3, 5, and 6), a gas supply conduit 4 connected with each burner 3, and a cooktop 2 with the respective burner 3 going through the same.

Each burner 3 comprises a flame detector 5 configured for detecting the presence/absence of flame in the burner 3. The flame detector 5 is connected to ground. In the embodiments shown in FIGS. 2 to 6, the flame detector 5 comprises a thermocouple connected to an electromagnetic safety valve 6 (schematically depicted in FIGS. 2, 3, 5, and 6) which allows or closes off the passage of gas to the corresponding burner 3.

In the embodiments shown in FIGS. 2, 3, 5, and 6, each burner 3 comprises a main body 9; 9' including a plurality of nozzles 7 configured for allowing the passage of gas outwards, and a cover 8 arranged on the main body 9; 9'. In other embodiments not depicted in the drawings, the cover may be integrated in the body, forming a single body.

The gas cooking appliance 1; 1'; 1"; 1''' further comprises an ignition device 11 comprising a pulse generator 13 configured for generating at least one electric pulse generating a spark which ignites the flame in the corresponding burner 3. The pulse generator 13 is in electrical contact with the burner 3.

Figure 3:
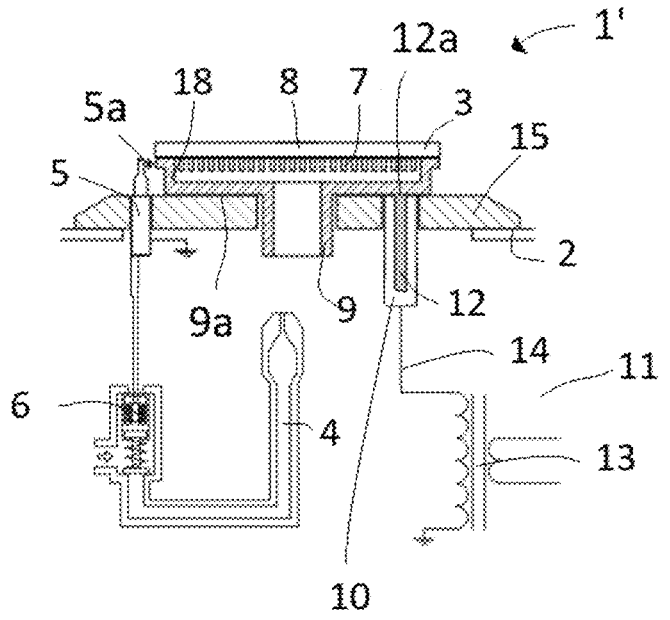
FIG. 3 shows a partial sectioned view of a gas cooking appliance according to a second embodiment with a diagram of its electrical connections.
Figure 5:
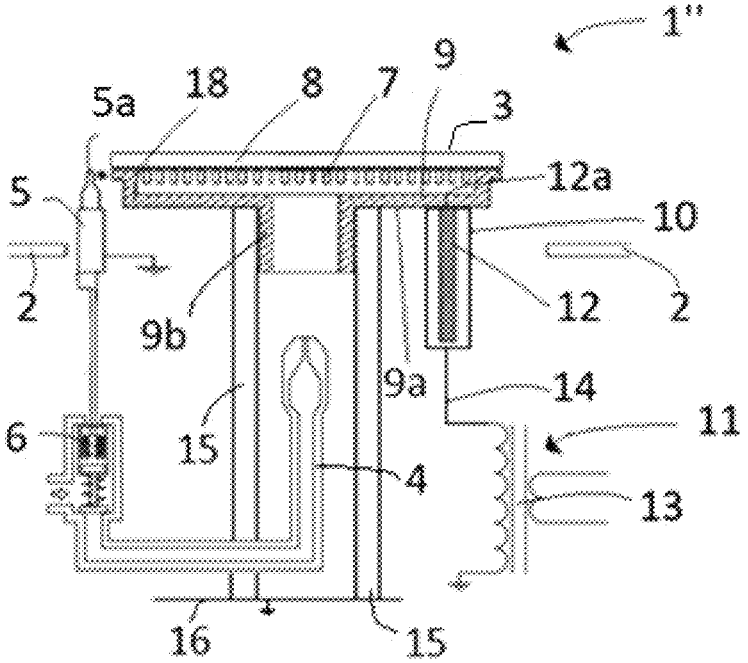
FIG. 5 shows a partial sectioned view of a cooking appliance according to a third embodiment with a diagram of its electrical connections.
Figure 6:
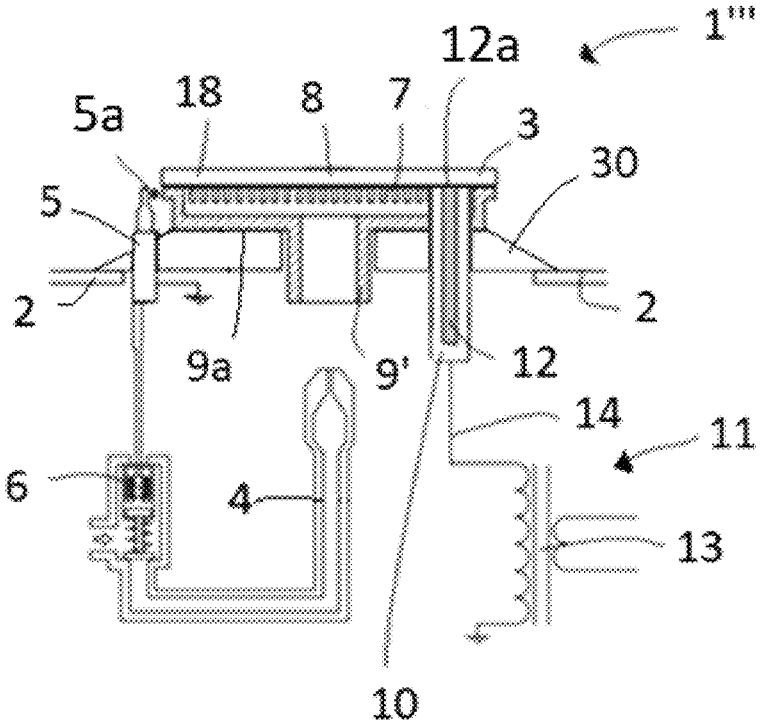
FIG. 6 shows a sectioned view of a cooking appliance according to a fourth embodiment.

In the embodiments shown in FIGS. 3, 5, and 6, the ignition device 11 comprises an electrode 12 connected to the pulse generator 13 through an ignition wire 14, the electrode 12 being in electrical contact with the burner 3.

Figure 2:
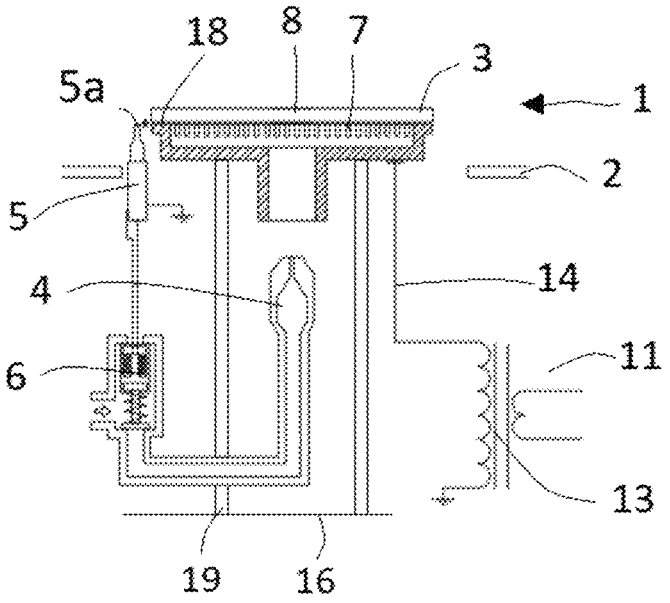
FIG. 2 shows a partial sectioned view of a gas cooking appliance according to a first embodiment with a diagram of its electrical connections.

In the first embodiment shown in FIG. 2, the ignition device 11 does not include the electrode 12. In this embodiment, the ignition wire 14 is in electrical contact with the main body 9 and is configured for conducting the signal generated by the pulse generator 13 directly to the burner 3.

In the embodiments shown in FIGS. 2, 3, and 5, the main body 9 is made of an electrically conductive material, preferably a metallic material. In these embodiments, an end 12*a* of the electrode 12 or the ignition wire 14 itself is arranged in direct contact with the main body 9, particularly against a base 9*a* of the main body 9, for conducting the signal generated by the pulse generator 13 to the burner 3. In other configurations not shown in the drawings, the electrode 12 or the ignition wire 14 can come into electrical contact with other outer or inner surfaces of the main body 9. The ignition device 11 further comprises an insulating element 10 longitudinally surrounding the electrode 12.

In the fourth embodiment shown in FIG. 6, the main body 9' of the burner 3 is made of an electrically insulating material, preferably a ceramic material. In this case, an end 12*a* of the electrode 12 is arranged in direct contact with the cover 8 made of an electrically conductive material, preferably a metallic material, such that it directs the signal generated by the pulse generator 13 to the cover 8. In this embodiment, the ignition device 11 also comprises an insulating element 10 longitudinally surrounding the electrode 12.

The gas cooking appliance 1; 1'; 1"; 1'" further comprises insulating means 15; 19; 9' insulating the burner 3 with respect to ground. The insulating means 15; 19; 9' allows an electric spark capable of igniting the burner 3 to be generated between the burner 3 and the flame detector 5 when the ignition device 11 sends at least one electric pulse. The electric pulse is transmitted through the electrode 12 or directly through the ignition wire 14 to the burner 3, with the spark being generated between the burner 3 and the flame detector 5. To that end, the burner 3 comprises at least one energizable area 18 configured for being energized by the pulse generator 13, the flame detector 5 and the energizable area 18 of the burner 3 being arranged such that the point connected to ground closest to the energizable area 18 is an end 5*a* of the flame detector 5.

In the embodiments shown in FIGS. 2, 3, and 5, the main body 9 of the burner 3 is made of an electrically conductive material, the energizable area 18 being comprised in the main body 9 of the burner 3. In these embodiments, the energizable area 18 extends along the entire main body 9. In other non-depicted embodiments, the main body can include one energizable area and other non-energizable areas.

In the fourth embodiment shown in FIG. 6, the main body 9' of the burner 3 is made of an insulating material, preferably a ceramic material, the energizable area 18 being comprised in the cover 8 of the burner 3 which is made of an electrically conductive material. In this embodiment, the energizable area 18 extends along the entire cover 8.

In the embodiments shown in the FIGS. 2, 3, 5, and 6, the insulating means comprises at least one insulating element 15; 19; 9' in contact with the energizable area 18. The insulating element 15; 19; 9' can be made of a ceramic, glass, plastic, bakelite, or other electrically insulating material.

In the first embodiment shown in FIG. 2 and in the third embodiment shown in FIG. 5, the insulating means comprises insulating elements 19 on which the body 9 of the burner 3 is supported, the burner 3 furthermore being fixed to a chassis 16 of the cooking appliance 1; 1' through the insulating elements 19. Furthermore, air acts as the main insulator. The distance from any point of the energizable area 18 to any ground point of the cooking appliance 1; 1" is greater than the minimum distance from the energizable area 18 to the end 5*a* of the thermocouple 5. In these embodiments, the energizable area 18 extends along the entire body 9 of the burner 3.

Figure 4:
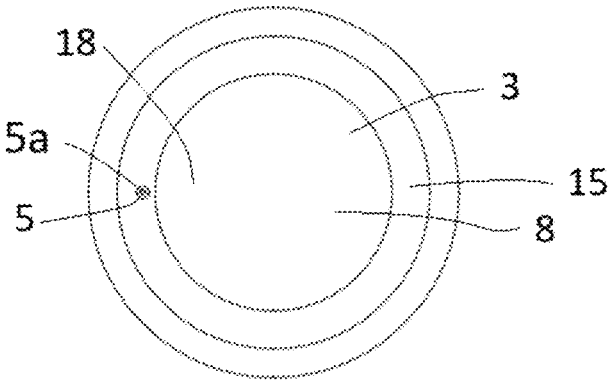
FIG. 4 shows a partial top view of the cooking appliance shown in FIG. 3.

In the second embodiment shown in FIGS. 3 and 4, the insulating means comprise an insulating element 15 having a substantially disk shape on which the main body 9 of the burner 3 is supported. The insulating element 15 is in turn supported on the cooktop 2. In particular, the insulating element 15 covers the base 9*a* of the main body 9. The main body 9, the electrode 12, and the thermocouple 5 go through the insulating element 15. In other non-depicted embodiments, the insulating element can have other geometries.

In the fourth embodiment shown in FIG. 6, the insulating means is formed by the body 9' of the burner 3. The body 9' is made of an insulating ceramic material. The cooking appliance 1'" further comprises a support 30 which is supported on the cooktop 2 and on which the body 9' of the burner 3, particularly a base 9*b* of the body 9', is supported. The thermocouple 5, the body 9' of the burner 3, and the electrode 12 go through the support 30. The support 30 does not have to be made of an insulating material as it could be a metallic trim.

The following clauses disclose additional embodiments.

Clause 1. Gas cooking appliance comprising at least one burner (3) connected to a gas supply, an ignition device (11) configured for igniting the burner (3), the ignition device (11) comprising a pulse generator (13) configured for sending at least one electric pulse generating a spark which ignites the burner (3), and a flame detector (5) configured for detecting the presence/absence of flame in the burner (3), the pulse generator (13) is in electrical contact with the burner (3), and the flame detector (5) is connected to ground, the cooking appliance (1; 1'; 1"; 1'") further comprising insulating means (15; 19; 19') insulating the burner (3) with respect to earth such that, when the pulse generator (13) of the ignition device (11) sends at least one electric pulse, an electric spark capable of igniting the burner (3) is generated between the burner (3) and the flame detector (5).

Clause 2. Gas cooking appliance according to clause 1, wherein the burner (3) comprises at least one energizable area (18) configured for being energized by the pulse generator (13), the flame detector (5) and the energizable area (18) of the burner (3) being arranged such that the point connected to earth closest to said area (18) is an end (5*a*) of the flame detector (5).

Clause 3. Gas cooking appliance according to clause 2, wherein the burner (3) comprises a main body (9) made of an electrically conductive material, the energizable area (18) being comprised in said main body (9) of the burner (3).

Clause 4. Gas cooking appliance according to any of clauses 2 or 3, wherein the insulating means comprise an insulating element (15; 19) in contact with the energizable area (18) of the burner (3).

Clause 5. Gas cooking appliance according to clause 2, wherein the burner (3) comprises a main body (9) made of an electrically insulating material and a cover (8) made of an electrically conductive material, the energizable area (18) being comprised in said cover (8).

Clause 6. Gas cooking appliance according to clause 5, wherein the insulating means are formed by the main body (9').

Clause 7. Gas cooking appliance according to any of the preceding clauses, wherein the flame detector (5) comprises a thermocouple connected to ground.

Clause 8. Gas cooking appliance according to any of the preceding clauses, wherein the ignition device (11) comprises an electrode (12) connected to the pulse generator (13) and in electrical contact with the burner (3).

Clause 9. Gas cooking appliance according to any of clauses 1 to 7, wherein the ignition device (11) comprises an ignition wire (14) connected to the pulse generator (13) and in electrical contact with the burner (3).

What is claimed is:

1. A gas cooking appliance comprising:

a burner;

an ignition device including a pulse generator configured to produce an electric pulse, the pulse generator being electrically coupled to the burner; and a flame detector connected to ground and configured to detect a presence or absence of a flame in the burner;

the burner being insulated with respect to earth such that, when the pulse generator produces the electric pulse, an electric spark capable of igniting the burner is generated between the burner and the flame detector.

2. The gas cooking appliance according to claim 1, wherein the burner includes an energizable area that is configured to be electrically energized by the electric pulse produced by the pulse generator, an end of the flame detector being a point connected to earth closest to the energizable area.

3. The gas cooking appliance according to claim 2, wherein the burner includes a main body made of an electrically conductive material, the energizable area being a part of the main body.

4. The gas cooking appliance according to claim 2, further comprising insulating means that includes an insulating element in contact with the energizable area of the burner.

5. The gas cooking appliance according to claim 3, further comprising insulating means that includes an insulating element in contact with the energizable area of the burner.

6. The gas cooking appliance according to claim 2, wherein the burner includes a main body made of an electrically insulating material and a cover made of an electrically conductive material, the energizable area being a part of the cover.

7. The gas cooking appliance according to claim 1, wherein the flame detector is a thermocouple coupled to ground.

8. The gas cooking appliance according to claim 1, further comprising an electrode electrically connected to the pulse generator and in electrical contact with a part of the burner.

9. The gas cooking appliance according to claim 1, wherein the ignition device includes an ignition wire connected to the pulse generator and in electrical contact with a part of the burner.

10. The gas cooking appliance according to claim 1, wherein the ignition device includes an ignition wire connected to and disposed between the pulse generator and the electrode.

11. The gas cooking appliance according to claim 8, further comprising an electrical insulating element longitudinally surrounding the electrode.

12. The gas cooking appliance according to claim 1, wherein the burner comprises a main body and a cover, the cover being made of an electrically conductive material, the pulse generator being electrically coupled to the cover.

13. The gas cooking appliance according to claim 12, wherein the main body is made of a material that is not electrically conductive.

14. The gas cooking appliance according to claim 13, wherein the main body is made of a ceramic material.

15. The gas cooking appliance according to claim 1, wherein the burner includes a main body, the gas cooking appliance further comprising an electrical insulating element disposed between the main body of the burner and a cooktop of the gas cooking appliance.

16. The gas cooking appliance according to claim 15, wherein the flame detector extends through a through opening in the insulating element.

17. The gas cooking appliance according to claim 1, wherein the burner includes a main body, the gas cooking appliance further comprising an insulating element disposed between the main body of the burner and a cooktop of the gas cooking appliance, the gas cooking appliance further including an electrode electrically connected to the pulse generator and in direct electrical contact with a part of the burner.

18. The gas cooking appliance according to claim 17, wherein the electrode extends through a first through opening in the insulating element.

19. The gas cooking appliance according to claim 18, wherein the flame detector extends through a second through opening in the insulating element.

* * * * *